US007216446B2

(12) United States Patent
Machala

(10) Patent No.: US 7,216,446 B2
(45) Date of Patent: May 15, 2007

(54) DYNAMIC MULTIPLE COMPARTMENT AIR INFLATABLE DISPLAY

(75) Inventor: William Machala, Smithfield, RI (US)

(73) Assignee: Chrisha Creations, Ltd., Greenville, RI (US)

( * ) Notice: Subject to any disclaimer, the term of this patent is extended or adjusted under 35 U.S.C. 154(b) by 0 days.

(21) Appl. No.: 11/127,489

(22) Filed: May 11, 2005

(65) Prior Publication Data

US 2006/0107573 A1 May 25, 2006

Related U.S. Application Data

(60) Provisional application No. 60/630,535, filed on Nov. 23, 2004.

(51) Int. Cl.
*G09F 15/00* (2006.01)

(52) U.S. Cl. ..... 40/610; 446/221

(58) Field of Classification Search ..... None
See application file for complete search history.

(56) References Cited

U.S. PATENT DOCUMENTS

| | | | | |
|---|---|---|---|---|
| 2,748,256 | A | 5/1956 | Morgan | |
| 3,066,439 | A | 12/1962 | Lemelson | |
| 3,159,935 | A * | 12/1964 | Rubens | 40/415 |
| 3,363,350 | A | 1/1968 | Moran | |
| 3,672,083 | A | 6/1972 | Moran | |
| 3,745,677 | A | 7/1973 | Moran | |
| 3,835,308 | A | 9/1974 | Reese | |
| 4,179,832 | A | 12/1979 | Lemelson | |
| 4,776,121 | A | 10/1988 | Vicino | |
| 4,995,186 | A | 2/1991 | Collie | |
| 5,088,952 | A * | 2/1992 | Goldblatt | 446/220 |
| 5,125,177 | A | 6/1992 | Colting | |
| 5,215,492 | A | 6/1993 | Kubiatowicz | |
| 5,710,543 | A | 1/1998 | Moore | |

(Continued)

FOREIGN PATENT DOCUMENTS

| | | |
|---|---|---|
| DE | 203 17200 U1 | 3/2004 |

(Continued)

OTHER PUBLICATIONS

Blowing deals is up their alley; Scherba's Big inflatables Super Bowl Bound. (Inflatable Images, David and Bob Scherba); Suttle, Scott; Crain's Cleveland Business, v22, n4, p. 3; Jan. 22, 2001; ISSN: 0197-2375.

(Continued)

*Primary Examiner*—Joanne Silbermann
(74) *Attorney, Agent, or Firm*—Morgan & Finnegan

(57) ABSTRACT

The invention is directed to an inflatable display that has a plurality of inflatable compartments. A first inflatable compartment is continuously inflated by a first fan element and at least a second inflatable compartment is periodically inflated by a second fan element. The inflatable display may be produced from permeable material and configured to represent a predetermined shape or design when inflated, such as a witch and caldron, Santa Claus and a chimney, or the Easter Bunny and an Easter egg. Further, the inflatable display may include a string of lights enclosed within a plastic shell to avoid damaging the inflatable display material by heat or fire. Also, the period associated with the operational inflation/deflation may be controlled by a variable controller connected to the second fan element.

34 Claims, 6 Drawing Sheets

U.S. PATENT DOCUMENTS

| | | | |
|---|---|---|---|
| 5,778,581 | A | 7/1998 | Bailey |
| 6,012,826 | A | 1/2000 | Chabert |
| 6,186,857 | B1 | 2/2001 | Gazit et al. |
| 6,276,815 | B1 | 8/2001 | Wu |
| 6,322,230 | B1 | 11/2001 | Medici |
| 6,431,729 | B1 | 8/2002 | Chen |
| 6,527,418 | B1 | 3/2003 | Scherba |
| 6,572,247 | B2 | 6/2003 | Liu |
| 6,644,843 | B2 | 11/2003 | Chin-Cheng |
| 6,764,201 | B2 | 7/2004 | Chi-Cheng |
| 2002/0089854 | A1 | 7/2002 | Liu |
| 2002/0095831 | A1 | 7/2002 | Tsai |
| 2005/0190556 | A1 | 9/2005 | Machala |

FOREIGN PATENT DOCUMENTS

EP WO 2005/107422 A 11/2005

OTHER PUBLICATIONS

Globalock Corp. —dba American Inflatables—Crosses Into the New Millennium. Business Wire, p. 0149; Jan. 3, 2000.

Air Time: Inflatables Have Designs on Promotional Markets; Promo, v0, n0, p. 61; Sep. 1994; ISSN: 1047-1707.

Reaching New Heights. (Air Dimensional Design Inc. makes inflatable marketing tools); Greenberg, David; Los Angeles Business Journal, v23, n18, p. 19; Apr. 13, 2001.

* cited by examiner

DYNAMIC MULTIPLE COMPARTMENT AIR INFLATABLE DISPLAY

CROSS-REFERENCE TO RELATED APPLICATION

This application claims priority from provisional U.S. Patent Application Ser. No. 60/630,535 entitled MULTI-COMPONENT AIR INFLATABLE DISPLAY filed in the name of William Machala on Nov. 23, 2004, the entirety of which is incorporated by reference herein.

FIELD OF THE INVENTION

The apparatus and method of the present invention relate to inflatable air displays with multiple inflatable compartments that maintain their inflated state through the use of a system of automatic fans or other inflation devices.

BACKGROUND OF THE INVENTION

Inflatable displays have become increasingly popular in recent years. These types of displays have a wide range of application, shape and size, including, but not limited to, figures for holiday and seasonal decoration, marketing, advertising, entertainment, and event attraction. The inflatable displays are made from a permeable fabric that allows air to pass through the fabric at approximately the same rate as the air being blown into the inflatable display. The process of continuously blowing air being supplied from a fan or other inflation device occurring at substantially the same rate as air escaping the fabric allows the display to maintain a three-dimensional shape without the use of an internal or external frame or structure. These are known in the industry as "cold-air" inflatable displays.

Typically, the cold-air inflatable display is a single figure comprised of pieces of permeable fabric configured to create an individual figure when inflated. For example, a consumer may decide to decorate their house with a jack-o-lantern inflatable display for the Halloween season, a snowman inflatable display for the holiday season, or an Uncle Sam inflatable display for Independence Day. As such, typically, the single figure is inflated and part of a static display. There is no present apparatus or method utilizing a fan assembly or other inflation assembly to inflate a single assembly having multiple inflation dynamic compartments.

SUMMARY OF THE INVENTION

In the present invention, an inflatable display is configured with multiple inflation compartments. A first compartment is inflated by a first fan element. The first compartment is operatively connected with a second inflatable compartment. For example, the second inflatable compartment may be situated within the first compartment. A second fan element is associated and configured to inflate the second compartment. A further aspect of the invention involves periodically turning the second fan on and off. According to an embodiment of the invention, there are a series of holes or slits formed in the surface of the second compartment, which enable a repeated inflation and deflation of the second compartment, while maintaining a fully inflated first compartment—thereby animating the inflatable display.

In another embodiment of the invention, the second compartment may be configured with a series of weights to assist in deflation when the second fan is deactivated. Accordingly, the air in the second compartment will escape and the second compartment will deflate. The multiple compartment, animated display assembly enables a greater range of display options, as well as achieves a greater overall visual effect to an observer.

It will be appreciated by those skilled in the art that the foregoing brief description and the following detailed description are exemplary and explanatory of this invention, but are not intended to be restrictive thereof or limiting of the advantages which can be achieved by this invention. Thus, the accompanying drawings, referred to herein and constituting a part hereof, illustrate preferred embodiments of this invention, and, together with the detailed description, serve to explain the principles of this invention.

BRIEF DESCRIPTION OF THE DRAWINGS

The features and advantages of the present invention, both as to its structure and operation, will be apparent from the following detailed description, especially when taken in conjunction with the accompanying drawings, wherein.

DETAILED DESCRIPTION OF THE INVENTION

Figure 1A:
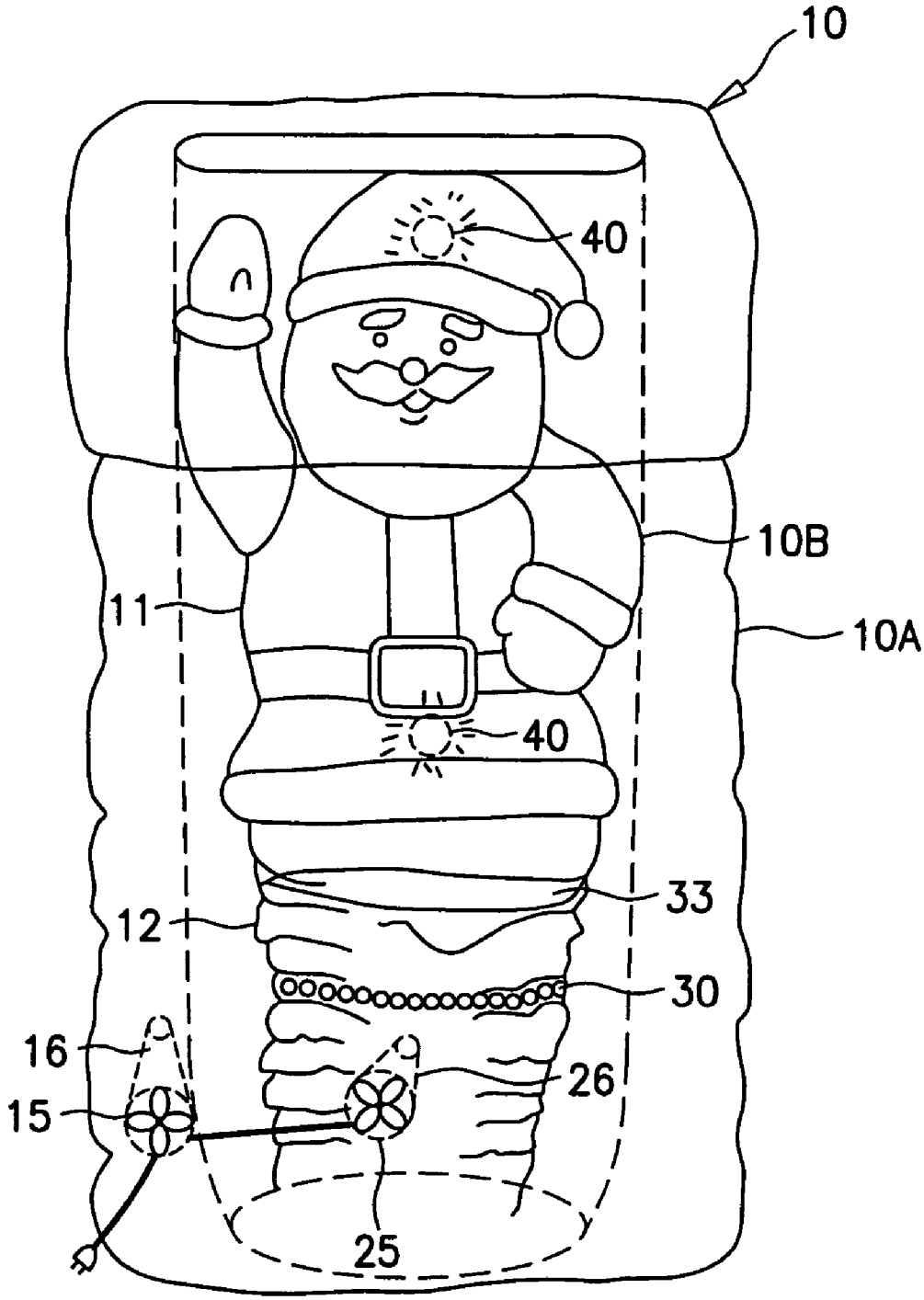
FIG. 1A is a front perspective view of a multiple compartment inflatable display illustrated with a second compartment in a deflated state according to an embodiment of the present invention.

The apparatus and method of the present invention will now be discussed with reference to FIGS. 1A, 1B, 2A, 2B, 3 and 4. The invention is directed to an inflatable display unit 10. The material of inflatable display 10 is preferably made from a permeable fabric that allows air to escape at approximately the same rate as air being blown into the inflatable display by fan elements 15 and 25. Inflatable display 10, shown in this embodiment as a chimney and Santa Claus, may be configured in any character, shape or size, depending on the specific need and purpose of the display. Inflatable display 10 is held in position by a securing mechanism, such as, a ballast or a tether that fastens to either the ground or another structure and is secured to said inflatable display by securing devices, such as a securing ring attached to inflatable display 10.

The inflatable display may include interior lighting arrangement 41 (shown in FIGS. 1B and 2B) that includes one or more light bulbs 40 secured to a power cord. Protective covers are secured around each light bulb 40 to protect the permeable fabric of inflatable display 10 from heat produced from each bulb. Interior lighting arrangement 41 is attached to fan assembly (15 and 25) through an electrical connector on the bottom end of a power cord that mates with fan assembly (15 and 25). Advantageously, if an operator does not want to illuminate the display, he/she may simply detach the electrical connector from the fan assembly element to remove power from interior lighting arrangement 41, without necessarily removing lights from within the display.

As illustrated, fan elements 15 and 25 are preferably implemented as a lightweight plastic sleeveless bearing fan. The lightweight of the electric fan assembly and the plastic housing enables the fan assembly to be secured to the fabric of the inflatable display at a position elevated above the surface-touching bottom of the display without distorting the shape of the inflatable display and without the need for a base to support and elevate the fan above the ground to achieve sufficient air intake. Advantageously, fan elements 15 and 25 can be easily removed from their respective housings for cleaning or replacement whenever necessary. Fan elements 15 and 25 are covered with safety grill to guard against unwanted debris from entering the display as well as contacting fan blades.

Furthermore, as illustrated in FIGS. 1A, 1B, 2A and 2B, inflatable display 10 is comprised of two inflatable compartments 10A and 10B. By way of example only, inflatable display 10 in FIGS. 1A–2B is shown as a chimney (first) inflatable compartment 10A formed with a Santa Claus (second) inflatable compartment 10B. It is to be understood that the invention is not limited to such an embodiment. For example, other embodiments may comprise any number, shape or size compartments and associated fan elements or any characteristic components corresponding to any holiday or seasonal display, such as a rabbit and an Easter egg, a witch and a caldron, or many others.

As illustrated in FIGS. 1A–2B, the first compartment 10A is inflated by fan element 15 that is attached to compartment 10A via an air intake tube 16. Air tube 16 may be made of the same material as inflatable display 10, itself, and integrally formed as part of inflatable device 10. Further, air intake tube 16 may include fasteners on one end so that it is joined with fan element 15. This allows the inflatable elements to be interchangeable, simply by attaching a different inflatable display 10 to fan assembly (15 and 25).

Fan element 15 is responsible for maintaining first inflation compartment 10A in an inflated state. Further, second air intake tube 17 is used to connect first inflation compartment 10A with portion 11 of second inflation compartment 10B. For example, in the embodiment shown in FIGS. 1A and 1B, portion 11 is implemented as the body of Santa Claus. The second intake tube 17 allows inflatable display 10 to maintain portion 11 in an inflated state so long as fan element 15 is turned on. It is to be understood that depending on the actual implementation, the fan element may be configured in a manner such that it is raised above the ground, whether it is elevated by a stand or platform or by being fastened to a portion of the inflatable display.

Figure 1B:
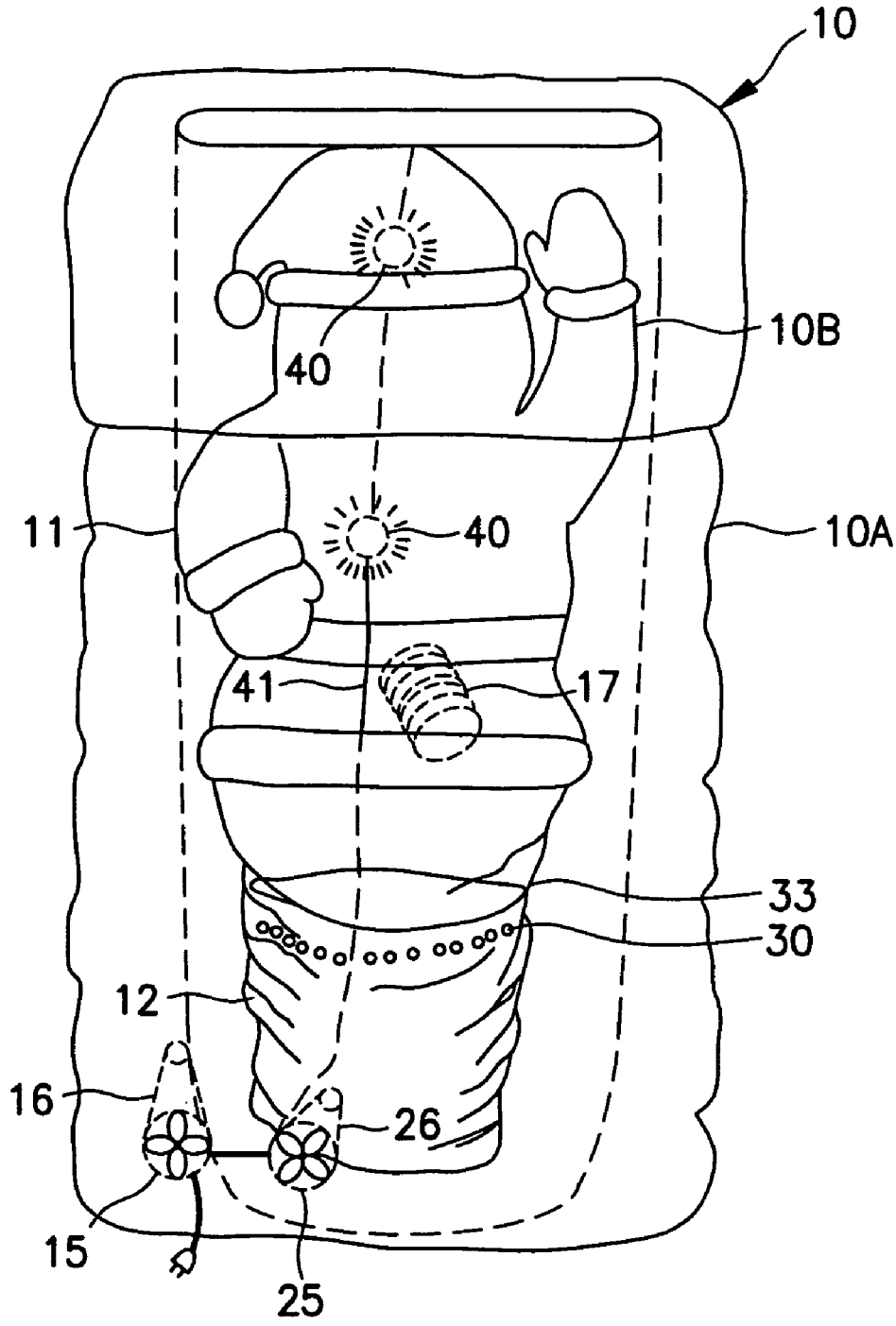
FIG. 1B is a rear perspective view of a multiple compartment inflatable display illustrated with a second compartment in a deflated state according to an embodiment of the present invention.

Second air intake tube 26 is fastened to second fan element 25, in order to achieve an animating effect for inflatable display 10. More specifically, second inflatable compartment 10B is divided into two portions, static portion 11 (the Santa Claus body 11) and dynamic inflation portion (extension portion 12), separated by partition 33. FIGS. 1A and 1B illustrate inflatable display 10 in a first state, wherein second inflatable compartment 10B is hidden within first inflatable compartment 10A (and extension portion 12 is un-inflated). In contrast, FIGS. 2A and 2B illustrate second inflatable compartment 10B extending through an aperture in first inflatable compartment 10A (extension portion 12 is inflated).

Second inflatable compartment 10B is divided into statically inflated portion 11 and dynamically inflated portion 12 (discussed above as the extension portion). Dynamically inflated portion 12 is connected with air intake tube 26 and consequently to fan element 25. In order to actuate second inflatable compartment 10B, power is periodically supplied to fan element 25. Upon supplying power to fan element 25, air is blown into dynamically inflatable portion 12, which expands as it receives the air.

Figure 2A:
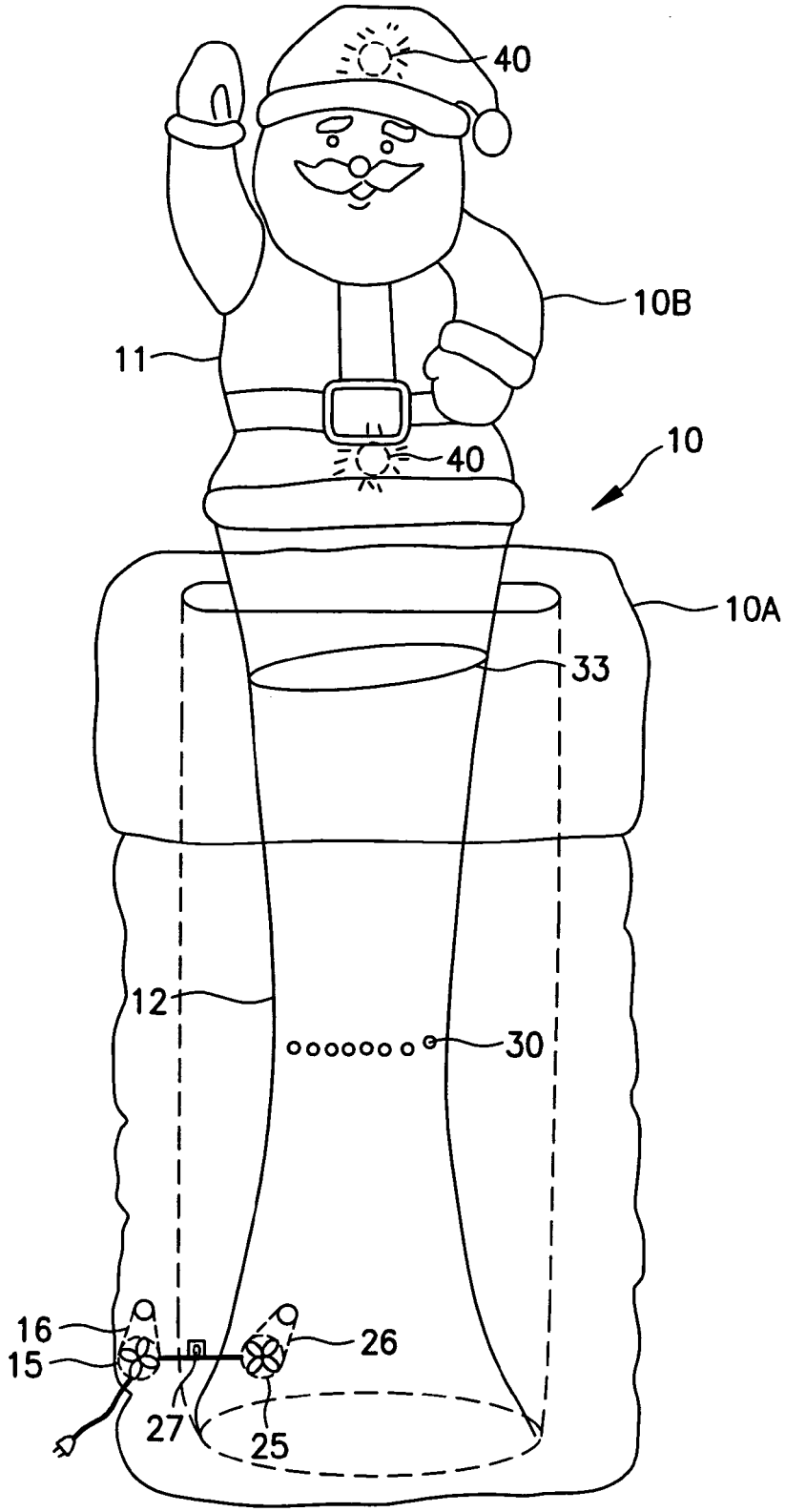
FIG. 2A is a front perspective view of a multiple compartment inflatable display illustrated with a second compartment in an inflated state according to an embodiment of the present invention.
Figure 2B:
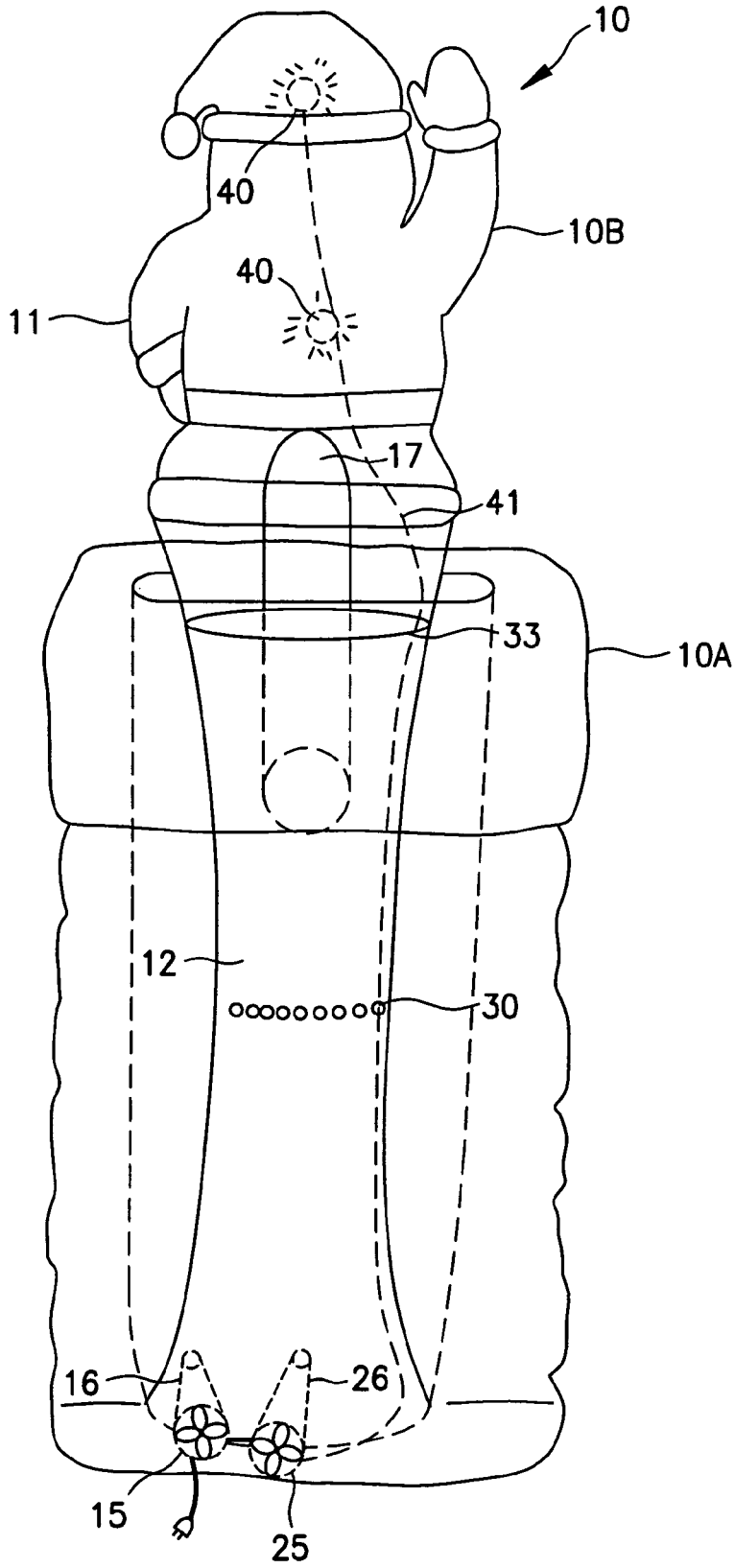
FIG. 2B is a rear perspective view of a multiple compartment inflatable display illustrated with a second compartment in an inflated state according to an embodiment of the present invention.

As shown in FIGS. 2A and 2B, when air is introduced into dynamically inflatable portion 12, static inflatable portion 11 rises into view and is no longer hidden. Dynamically inflatable portion 12 is secured to the base of first inflatable compartment 10B and is made from enough material, so that when in the inflated state, static inflatable portion 11 passes through the aperture in the first inflatable compartment and is held in full view of an observer. If power is removed from fan element 25, air escapes from dynamic inflatable portion 12 through exhaust ports 30. It is to be understood that the precise number, size, configuration of and form of exhaust ports 30 may vary based on the needs and design of the embodiment. For example, the exhaust ports may be formed as holes formed in a lateral ring (as illustrated in the figures) in dynamic inflatable portion 12. However, in other embodiments they may be formed as slits running lengthwise along an edge of the dynamic portion or they may take any other form that facilitates the effect of allowing the air in the dynamic portion to escape.

It is to be understood that during the periods of time when dynamic inflation portion 12 is fully inflated, fan element 25 is operated at a speed to overcome the effect of ports allowing air to escape. Also, depending on the application, it is to be understood that the frequency associated with supplying power to and removing power from fan element 25 may be either predetermined by manufacturer or controlled by variable control switch 27 attached to fan element (15, 25) assembly, as shown in FIG. 2A. Moreover, as illustrated in FIGS. 1B and 2B, inflatable display 10 may include a string 41 of lights 40 that are disposed at intervals within first or second inflatable compartments (10A/10B).

Figure 3:
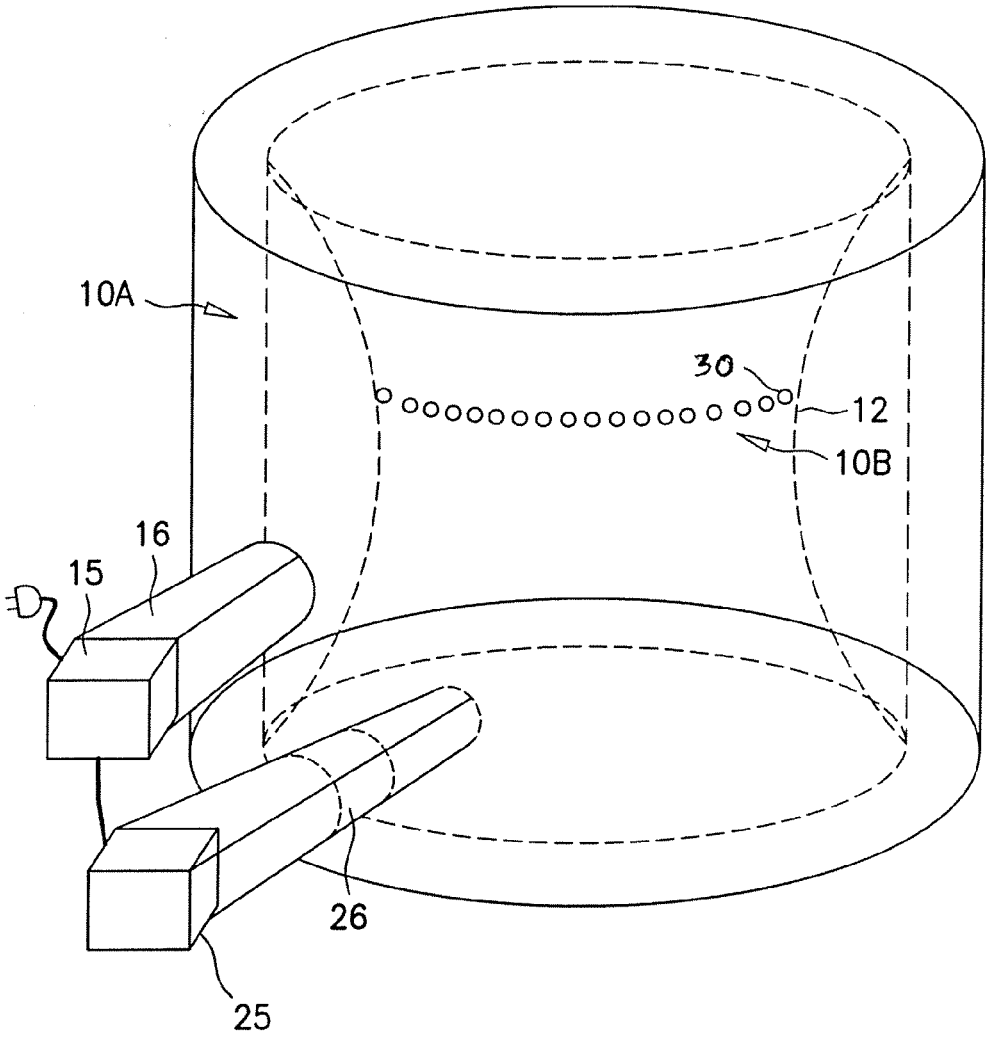
FIG. 3 illustrates a perspective cross-sectional view of an embodiment of the invention.

FIG. 3 illustrates a perspective cross-sectional view of an embodiment of the invention. More specifically, FIG. 3 illustrates a perspective view of FIGS. 2A and 2B, wherein the dynamic inflation portion is fully inflated. As discussed above, the invention implements a multiple fan assembly (15 and 25). The first fan element 15 is connected with air intake tube 16 to first inflation compartment 10A.

Generally, during operation, fan element 15 is always on and maintains the first inflation compartment 10A in an inflated state. In contrast, fan element 25 is switched between a powered state and an unpowered state. Consequently, fan element 25 supplies air through air intake 26 to dynamic inflation portion 12 of second inflation compartment 1GB. This achieves the effect of second inflation compartment 10B rising above first inflation compartment 10A. With respect to the embodiment discussed herein, Santa 10B rises from chimney 10A, while power is supplied to fan element 25, and falls back into chimney 10A when the power is removed from fan element 25, as the air in dynamic inflation portion 12 escapes through exhaust ports 30.

Figure 4:
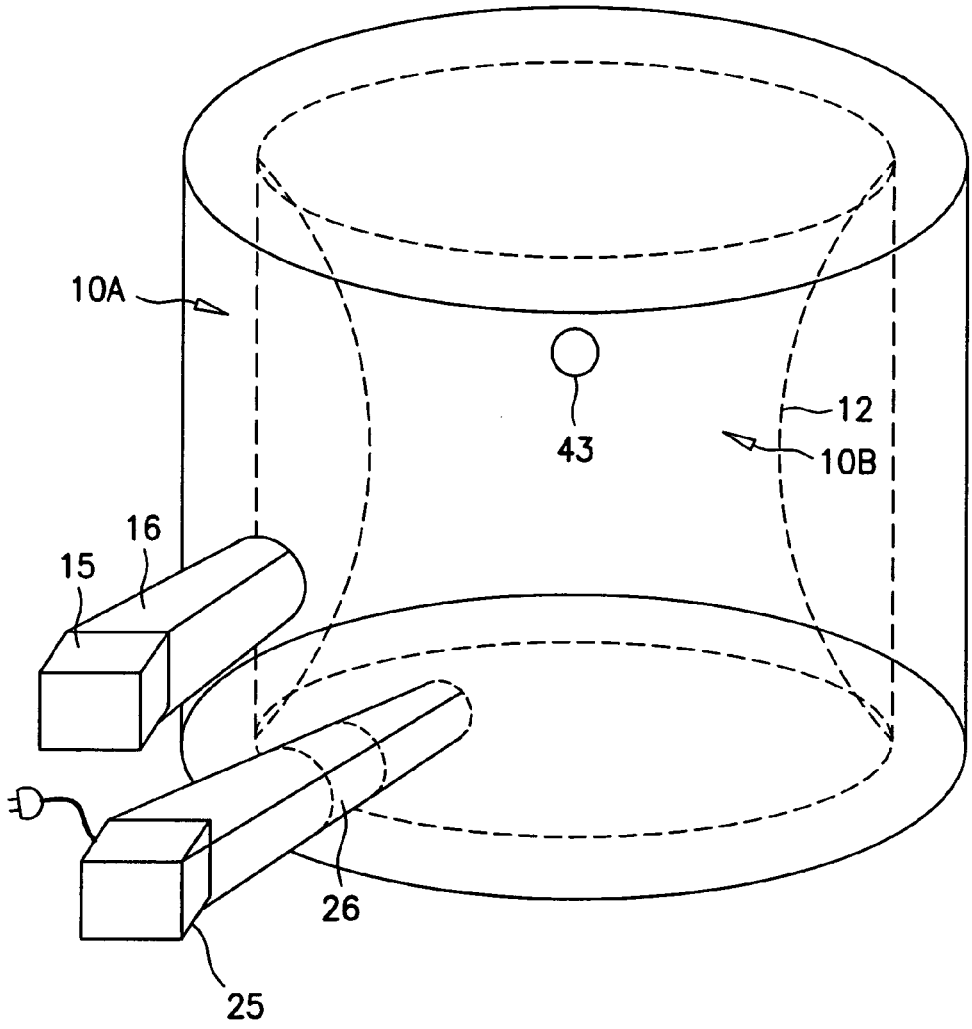
FIG. 4 illustrates a perspective cross-sectional view of another embodiment of the invention.

FIG. 4 illustrates an alternate embodiment of the invention wherein the dynamic inflation portion 12 is not configured with exhaust ports 30. Instead, dynamic portion 12 is configured with at least one ballast element 43. The weight provided by ballast element 43 assists in bringing the static inflation portion 11, back within the inflatable compartment. It is to be understood that the number of ballast elements, the attachment points, and the weight of the ballast element may vary greatly among implementations.

Although illustrative preferred embodiments have been described herein in detail, it should be noted and will be appreciated by those skilled in the art that numerous variations may be made within the scope of this invention without departing from the principle of this invention and without sacrificing its chief advantages. The terms and expressions have been used as terms of description and not terms of limitation. There is no intention to use the terms or expressions to exclude any equivalents of features shown and described or portions thereof and this invention should be defined in accordance with the claims which follow.

The invention claimed is:

1. An inflatable display comprising:

a first inflatable compartment;

a second inflatable compartment including a statically inflated portion and a dynamically inflated portion;

a first fan element providing a continuous air flow to inflate the first inflatable compartment and the statically inflated portion of said second inflatable compartment; and a second fan element providing a periodic air flow to inflate and deflate the dynamic inflated portion of said second inflatable compartment.

2. The inflatable display of claim 1, wherein the second inflatable compartment is configured with at least one ballast element.

3. The inflatable display of claim 2, wherein at least one illumination module is disposed within the first inflatable compartment.

4. The inflatable display of claim 3, wherein at least one illumination module is disposed within the second inflatable compartment.

5. The inflatable display of claim 4, wherein the illumination modules are operatively connected to one fan element.

6. The inflatable display of claim 5, wherein the fan elements are situated within the inflatable display.

7. The inflatable display of claim 6, wherein the second inflatable compartment includes an extension portion.

8. The inflatable display of claim 5, wherein the fan elements are secured to the inflatable display.

9. The inflatable display of claim 2, wherein the ballast element is attached to a dynamic inflatable portion of the second inflatable compartment to assist in deflating the portion.

10. The inflatable display of claim 9, wherein the second fan element is configured to operate for an initial predetermined length of time that is longer than a periodic operational airflow frequency.

11. The inflatable display of claim 1, wherein the second inflatable compartment is configured with at least one exhaust port.

12. The inflatable display of claim 1, further comprising at least one air intake tube associated with said first fan element and said first inflatable compartment.

13. The inflatable display of claim 12, further comprising at least one second air intake tube associated with said second fan element and said second inflatable compartment.

14. The inflatable display of claim 1, further comprising at least one air intake tube associated with said second fan element and said second inflatable compartment.

15. The inflatable display of claim 1, wherein the periodic air flow to inflate and deflate is controlled by a variable controller.

16. The inflatable display of claim 1, wherein the periodic air flow to inflate or deflate is predetermined.

17. An inflatable display comprising:

at least one first inflatable compartment continuously inflated by a first fan element; and at least one second inflatable compartment including a statically inflated portion continuously inflated by said first fan element and a dynamically inflated portion periodically inflated and deflated by a second fan element.

18. The inflatable display of claim 17, wherein the second inflatable compartment is configured with at least one ballast element.

19. The inflatable display of claim 18, wherein the ballast element is attached to a dynamic inflatable portion of the second inflation compartment to assist in deflating the portion.

20. The inflatable display of claim 19, wherein the second fan element is configured to operate for an initial predetermined length of time that is longer than a periodic operational airflow frequency.

21. The inflatable display of claim 17, wherein at least one illumination module is disposed within the first inflatable compartment.

22. The inflatable display of claim 21, wherein at least one illumination module is disposed within the second inflatable compartment.

23. The inflatable display of claim 22, wherein the illumination modules are operatively connected to one fan element.

24. The inflatable display of claim 23, wherein the fan elements are situated within the inflatable display.

25. The inflatable display of claim 23, wherein the fan elements are secured to the inflatable display.

26. The inflatable display of claim 23, wherein the second inflatable compartment includes an extension portion.

27. The inflatable display of claim 17, further comprising at least one air intake tube associated with said first fan element and said first inflatable compartment.

28. The inflatable display of claim 27, further comprising at least one second air intake tube associated with said second fan element and said second inflatable compartment.

29. The inflatable display of claim 17, further comprising at least one air intake tube associated with said second fan element and said second inflatable compartment.

30. The inflatable display of claim 17, wherein the periodically inflated and deflated second inflatable compartment is controlled by a variable controller.

31. The inflatable display of claim 17, wherein the periodically inflated and deflated second inflatable compartment occurs at a predetermined frequency.

32. A method for inflating a dynamic multiple compartment inflatable display comprising:

continuously inflating at least one inflatable compartment and a statically inflated portion of a second inflatable compartment; and periodically inflating and deflating a dynamically inflated portion of said second inflatable compartment.

33. The method of claim 32, wherein the step of periodically inflating and deflating is predetermined.

34. The method of claim 32, wherein the step of periodically inflating and deflating is controlled by a variable controller.

* * * * *

UNITED STATES PATENT AND TRADEMARK OFFICE

CERTIFICATE OF CORRECTION

PATENT NO. : 7,216,446 B2
APPLICATION NO. : 11/127489
DATED : May 15, 2007
INVENTOR(S) : William Machala It is certified that error appears in the above-identified patent and that said Letters Patent is hereby corrected as shown below:

At column 4 line 54, delete "1GB" and insert --10B--

Signed and Sealed this

Twentieth Day of May, 2008

JON W. DUDAS
*Director of the United States Patent and Trademark Office*